US007900615B2

(12) United States Patent
Wang et al.

(10) Patent No.: US 7,900,615 B2
(45) Date of Patent: Mar. 8, 2011

(54) AIR-FUEL IMBALANCE DETECTION BASED ON ZERO-PHASE FILTERING

(75) Inventors: Zhong Wang, Bellevue, WA (US); Lan Wang, Troy, MI (US); Ian J. Mac Ewen, White Lake, MI (US); Igor Anilovich, Walled Lake, MI (US); Steven Ward Majors, Howell, MI (US); Cheol S. Lee, Ann Arbor, MI (US)

(73) Assignee: GM Global Technology Operations, Inc.

( * ) Notice: Subject to any disclaimer, the term of this patent is extended or adjusted under 35 U.S.C. 154(b) by 210 days.

(21) Appl. No.: 12/243,045

(22) Filed: Oct. 1, 2008

(65) Prior Publication Data

US 2010/0077728 A1 Apr. 1, 2010

(51) Int. Cl.
*F02D 41/00* (2006.01)

(52) U.S. Cl. ..... 123/672; 701/109

(58) Field of Classification Search ..... 701/109; 123/672, 703; 60/276, 285
See application file for complete search history.

(56) References Cited

U.S. PATENT DOCUMENTS

| | | | | |
|---|---|---|---|---|
| 5,845,491 | A * | 12/1998 | Yasui et al. | 60/276 |
| 6,026,793 | A * | 2/2000 | Yasui et al. | 123/674 |
| 6,029,641 | A * | 2/2000 | Suzuki et al. | 123/673 |
| 6,125,831 | A * | 10/2000 | Yasui et al. | 123/674 |
| 6,382,198 | B1 * | 5/2002 | Smith et al. | 123/673 |
| 6,668,812 | B2 | 12/2003 | Javaherian | |
| 6,726,819 | B2 * | 4/2004 | Atsumi et al. | 204/428 |
| 6,996,974 | B2 | 2/2006 | Anilovich et al. | |
| 7,024,302 | B2 * | 4/2006 | Mizuno et al. | 701/109 |
| 7,152,594 | B2 | 12/2006 | Anilovich et al. | |
| 7,445,698 | B2 * | 11/2008 | Hada et al. | 204/401 |
| 2004/0030484 | A1 * | 2/2004 | Yasui et al. | 701/108 |
| 2007/0125347 | A1 * | 6/2007 | Nakagawa et al. | 123/672 |

FOREIGN PATENT DOCUMENTS

JP 60-73022 * 4/1985

* cited by examiner

*Primary Examiner* — Hai H Huynh

(57) ABSTRACT

A control system comprising an oxygen sensor that generates an oxygen signal based on an oxygen concentration level in an exhaust gas of an engine, a filtering module that determines a filtered signal based on the oxygen signal, and an air-fuel imbalance detection module that detects an air-fuel imbalance in the engine based on the oxygen signal and the filtered signal. A method comprising generating an oxygen signal based on an oxygen concentration level in an exhaust gas of an engine, determining a filtered signal based on the oxygen signal, and detecting an air-fuel imbalance in the engine based on the oxygen signal and the filtered signal.

20 Claims, 6 Drawing Sheets

AIR-FUEL IMBALANCE DETECTION BASED ON ZERO-PHASE FILTERING

FIELD

The present invention relates to engine control, and more particularly to engine emission control using air-fuel imbalance detection.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines compress and ignite a mixture of air and fuel in a cylinder to produce power. An imbalance in the air-fuel mixture may produce excessive emissions in exhaust gases exiting the cylinders. An oxygen concentration sensor may measure oxygen concentration levels in the exhaust gas. By measuring the oxygen concentration in the exhaust gas, the air-fuel mixture may be adjusted to improve combustion efficiency and reduce excessive emissions.

SUMMARY

Accordingly, the present disclosure provides a control system comprising an oxygen sensor that generates an oxygen signal based on an oxygen concentration level in an exhaust gas of an engine, a filtering module that determines a filtered signal based on the oxygen signal, and an air-fuel imbalance detection module that detects an air-fuel imbalance in the engine based on the oxygen signal and the filtered signal. In addition, the present disclosure provides a method comprising generating an oxygen signal based on an oxygen concentration level in an exhaust gas of an engine, determining a filtered signal based on the oxygen signal, and detecting an air-fuel imbalance in the engine based on the oxygen signal and the filtered signal.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
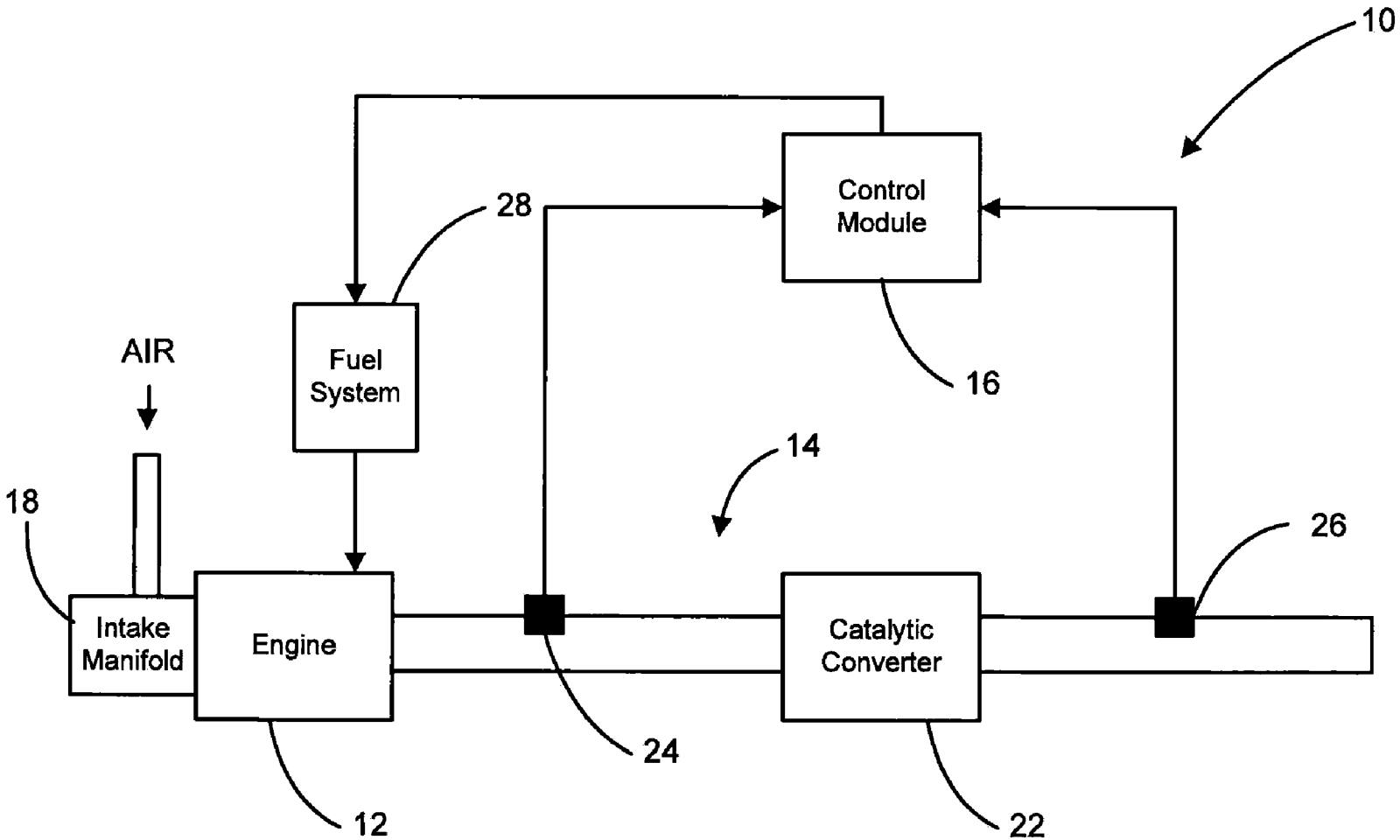
FIG. 1 is a functional block diagram of a vehicle including an air-fuel imbalance system according to the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

Referring now to FIG. 1, a vehicle 10 includes an engine 12, an exhaust system 14 and a control module 16. Air is drawn into the engine through an intake manifold 18. The air is combusted with fuel inside cylinders (not shown) of the engine 12. Exhaust produced by the combustion process exits the engine 12 through the exhaust system 14. The exhaust system 14 includes a catalytic converter 22, a pre-catalyst or inlet oxygen ($O_2$) sensor 24 and a post-catalyst or outlet oxygen ($O_2$) sensor 26. The exhaust gas is treated in the catalytic converter 22 and is released to atmosphere.

The inlet and outlet $O_2$ sensors 24, 26 generate signals based on the $O_2$ content of the exhaust gas. The signals are communicated to the control module 16. The control module 16 determines the A/F ratio based on the signals. The control module 16 communicates with a fuel system 28, which regulates fuel flow to the engine 12. In this manner, the control module 16 adjusts and regulates the A/F ratio to the engine 12.

The inlet and outlet $O_2$ sensors 24, 26 are typically narrow range switching sensors. It is appreciated, however, that the inlet and outlet $O_2$ sensors 24, 26 are not limited to narrow range type switching sensors. Voltage output signals that are generated by the $O_2$ sensors 24, 26 are based on the $O_2$ content of the exhaust passing the $O_2$ sensors relative to stoichiometry. The signals transition between lean and rich in an A/F ratio range that brackets the stoichiometric A/F ratio. The $O_2$ sensor signal that is generated by the inlet $O_2$ sensor 24 switches back and forth between rich and lean values.

The control module 16 regulates the fuel flow based on the $O_2$ sensor signals. For example, if the inlet $O_2$ sensor signal indicates a lean condition, the control module 16 increases fuel flow to the engine 12. Conversely, if the inlet $O_2$ sensor signal indicates a rich condition, the control module 16 decreases fuel flow to the engine 12. The amount of fuel is determined based on fuel offset gains, which are determined based on the sensor signals.

An air-fuel imbalance in the engine 12 causes fast switching of the $O_2$ sensor 24, yielding a high frequency $O_2$ sensor signal. The amount of air flowing through the intake manifold 18 and the rotational speed of the engine 12 may cause undesired exhaust gas separation. Depending on sensitivity level of the $O_2$ sensor 24, exhaust gas separation may cause $O_2$ sensor signal noise and false diagnosis of an air-fuel imbalance. The air-fuel imbalance detection system and method of the present disclosure has a sufficient signal-to-noise (S/N) ratio to prevent false diagnosis of an air-fuel imbalance.

The air-fuel imbalance detection system and method of the present disclosure detects an air-fuel imbalance in the engine 12 based on an $O_2$ sensor signal. More specifically, the air-fuel imbalance detection system and method filters the $O_2$ sensor signal and detects an air-fuel imbalance based on the unfiltered $O_2$ sensor signal and the filtered $O_2$ sensor signal. The air-fuel imbalance detection system and method employs a filter that removes any high-frequency imbalance from the unfiltered $O_2$ sensor signal such that the unfiltered and filtered $O_2$ sensor signals may be used to identify an air-fuel imbalance. A sufficient S/N ratio is achieved through a filter that removes any high-frequency imbalance but does not remove noise due to sensitivity of the $O_2$ sensor 24.

The control module 16 detects an air-fuel imbalance according to the principles of an air-fuel imbalance detection system and method of the present disclosure. When the engine 12 is running, the control module 16 filters the $O_2$ sensor signal using a zero-phase, low-pass digital filter to obtain the filtered $O_2$ sensor signal. The control module 16 calculates a difference between the $O_2$ sensor signal and the filtered $O_2$ sensor signal and calculates a variance based on the difference to yield an index that indicates an air-fuel imbalance level. When the index exceeds a predetermined threshold, the control module 16 detects an air-fuel imbalance.

Figure 2:
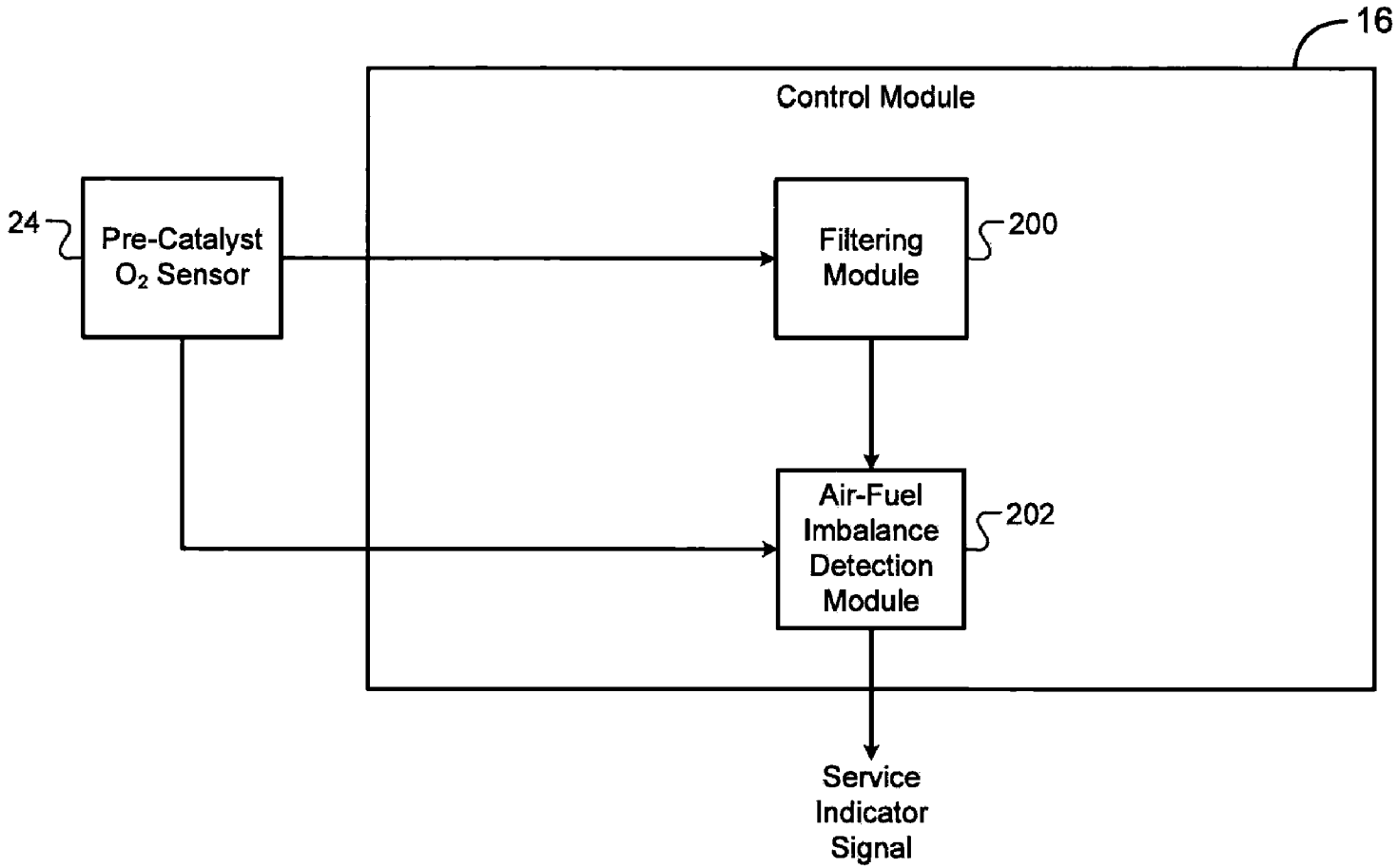
FIG. 2 is a functional block diagram of a control module according to the present disclosure.

Referring now to FIG. 2, the control module 16 includes a filtering module 200 and an air-fuel imbalance detection module 202. The filtering module 200 receives the $O_2$ sensor signal from the pre-catalyst $O_2$ sensor 24. The filtering module 200 filters the $O_2$ sensor signal using a low-pass filter to yield a filtered $O_2$ sensor signal. The low-pass filter removes high frequency content indicative of an air-fuel imbalance from the $O_2$ sensor signal. The low-pass filter is also a zero-phase filter, or a filter having precisely zero-phase distortion.

The air-fuel imbalance detection module 202 receives the unfiltered $O_2$ sensor signal from the pre-catalyst $O_2$ sensor 24 and the filtered $O_2$ sensor signal from the filtering module 200. The air-fuel imbalance detection module 202 calculates a difference between the unfiltered and filtered $O_2$ sensor signals and determines a variance of the difference. More specifically, the air-fuel imbalance detection module 202 sets the variance equal to the square of the difference between the unfiltered and filtered $O_2$ sensor signals.

The air-fuel imbalance detection module 202 determines an index of an air-fuel imbalance level based on the variance. More specifically, the air-fuel imbalance detection module 202 may set the index equal to the variance. Alternatively, the air-fuel imbalance detection module 202 may filter the variance and set the index equal to the filtered variance to avoid false detection of an air-fuel imbalance due to variations in an unfiltered index. The air-fuel imbalance detection module 202 determines whether the index exceeds a predetermined threshold. When the index exceeds the predetermined threshold, the air-fuel imbalance detection module 202 detects an air-fuel imbalance and generates a service indicator signal.

Figure 3:
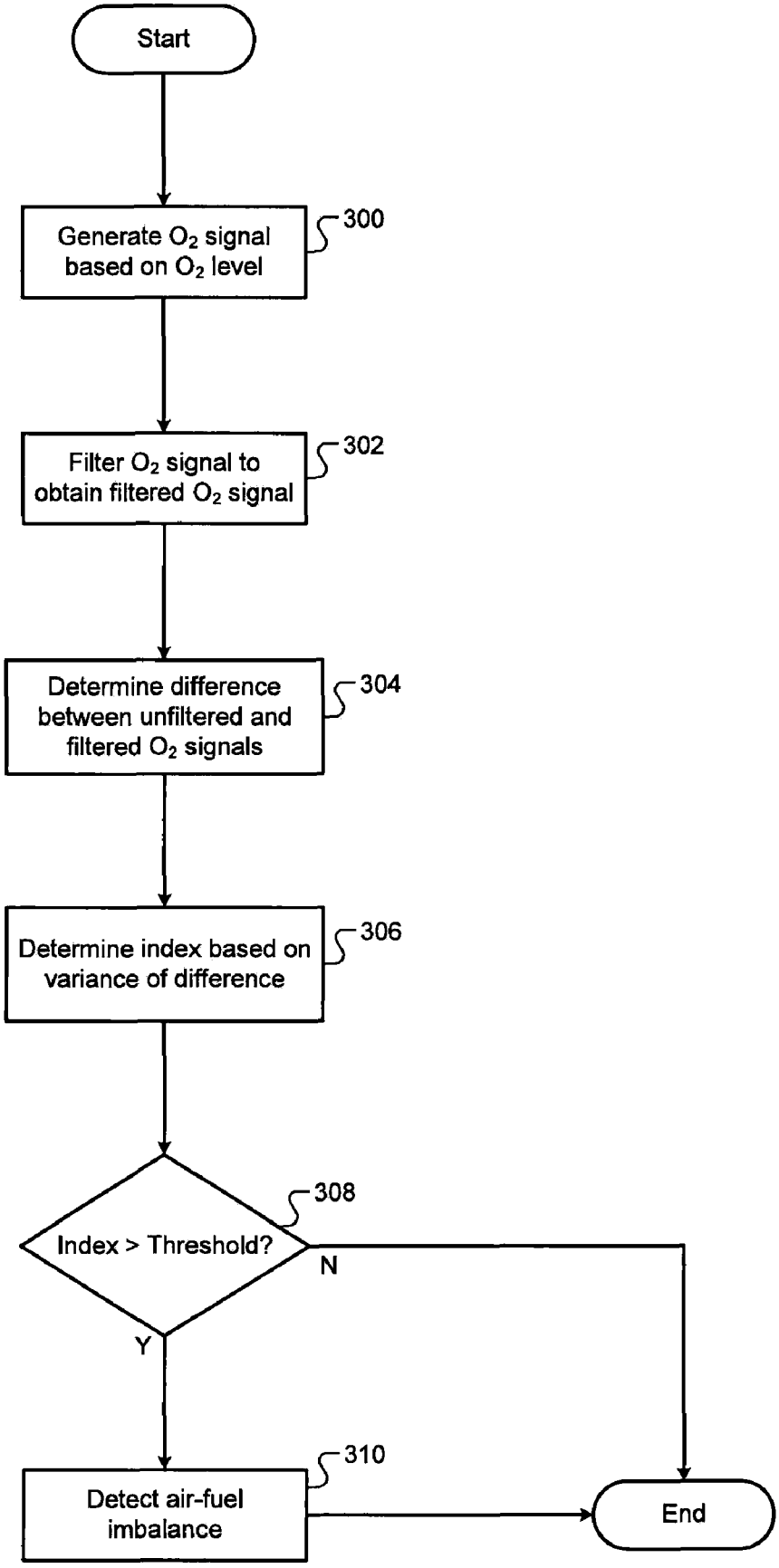
FIG. 3 is a flowchart illustrating exemplary steps of an air-fuel imbalance detection method according to the present disclosure.

Referring now to FIG. 3, exemplary steps of an air-fuel imbalance detection method according to the present disclosure will be described. In step 300, control generates an $O_2$ sensor signal based on an $O_2$ concentration level in an exhaust gas of an engine. In step 302, control filters the $O_2$ sensor signal to obtain a filtered $O_2$ sensor signal. In steps 304 through 310, control detects an air-fuel imbalance based on the unfiltered and filtered $O_2$ sensor signals.

In step 304, control determines a difference between the unfiltered and filtered $O_2$ sensor signals. In step 306, control determines an index of an air-fuel imbalance level based on a variance or square of the difference. More specifically, control may set the index equal to the variance. Alternatively, control may filter the variance and set the index equal to the filtered variance to avoid false detection of an air-fuel imbalance due to variations in an unfiltered index.

In step 308, control determines whether the index of the air-fuel imbalance level exceeds a predetermined air-fuel imbalance level threshold. When the index exceeds the threshold, control detects an air-fuel imbalance in step 310. For robustness (i.e., avoidance of false air-fuel imbalance detection), control may detect the air-fuel imbalance when the index exceeds the threshold for a predetermined time period. Control may set a service indicator, such as a diagnostic trouble code (DTC), when an air-fuel imbalance is detected. Since $O_2$ sensors typically measure $O_2$ content of exhaust gas exiting a single bank of cylinders, control may set independent service indicators for each bank.

Figure 4:
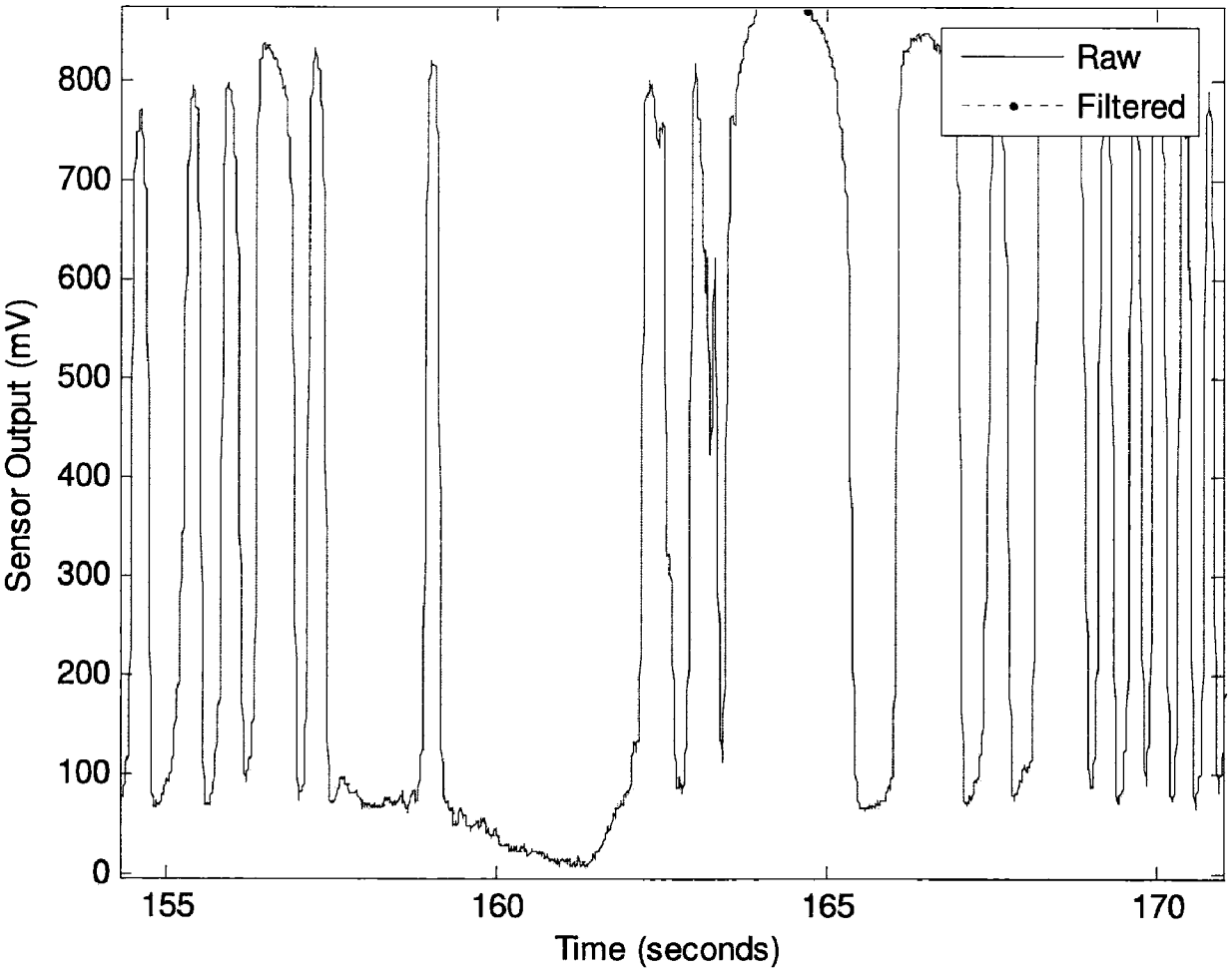
FIG. 4 illustrates exemplary signals representing oxygen content in an exhaust gas of an engine having no air-fuel imbalance.

Referring now to FIG. 4, exemplary raw (i.e., unfiltered) and filtered $O_2$ sensor signals indicative of an engine having no air-fuel imbalance are illustrated. The y-axis represents the $O_2$ sensor output, and the x-axis represents the time period that the $O_2$ sensor signal was monitored to detect an air-fuel imbalance. Variation between the raw and filtered $O_2$ sensor signals is minimal. In addition, no phase shift exists between the filtered and unfiltered $O_2$ sensor signals as a zero-phase filter was used to obtain the filtered $O_2$ sensor signal.

Figure 5:
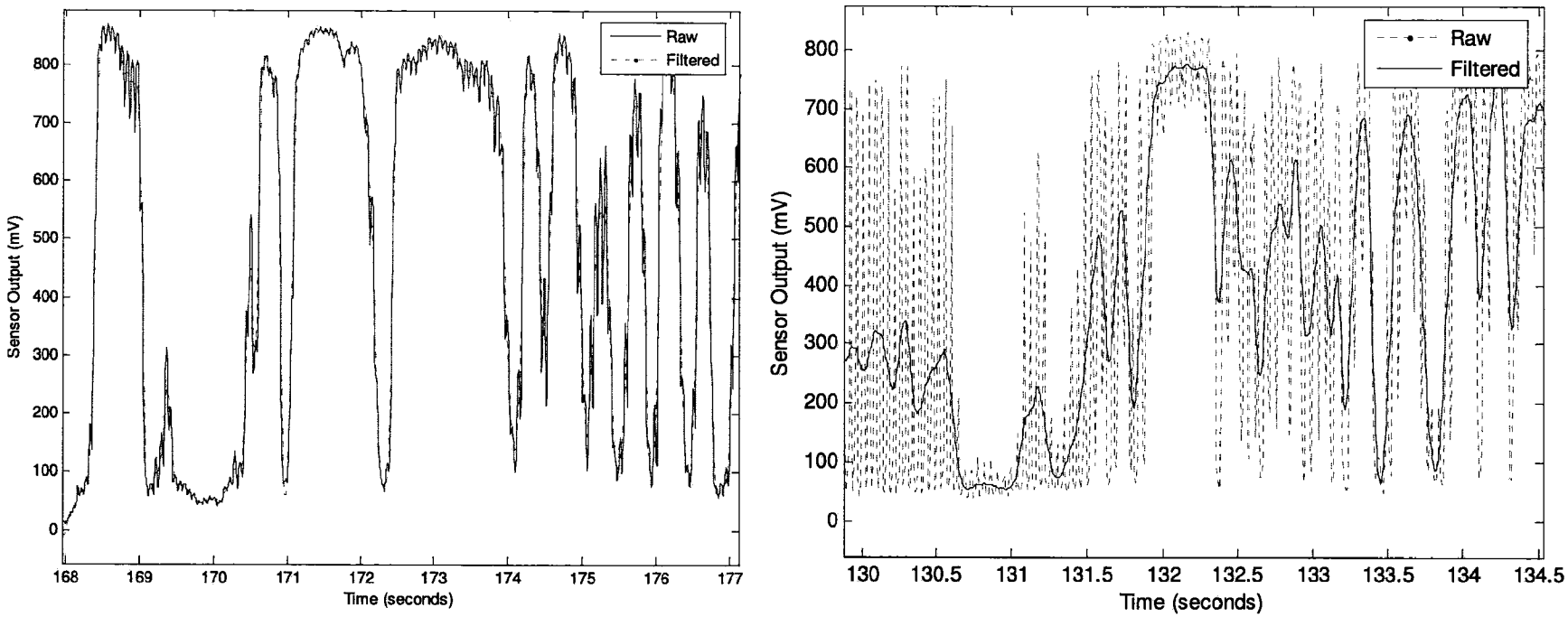
FIG. 5 illustrates exemplary signals representing oxygen content in an exhaust gas of an engine having an air-fuel imbalance.

Referring now to FIG. 5, exemplary raw and filtered $O_2$ sensor signals indicative of an engine having an air-fuel imbalance are illustrated. The y-axis represents the $O_2$ sensor output, and the x-axis represents the time period that the $O_2$ sensor signal was monitored to detect an air-fuel imbalance. In the graph on the left, a moderate amount of variation exists between the raw and filtered $O_2$ sensor signals due to a moderate amount of air-fuel imbalance. In the graph on the right, a significant amount of variation exists between the raw and filtered $O_2$ sensor signals due to a significant amount of air-fuel imbalance.

Figure 6:
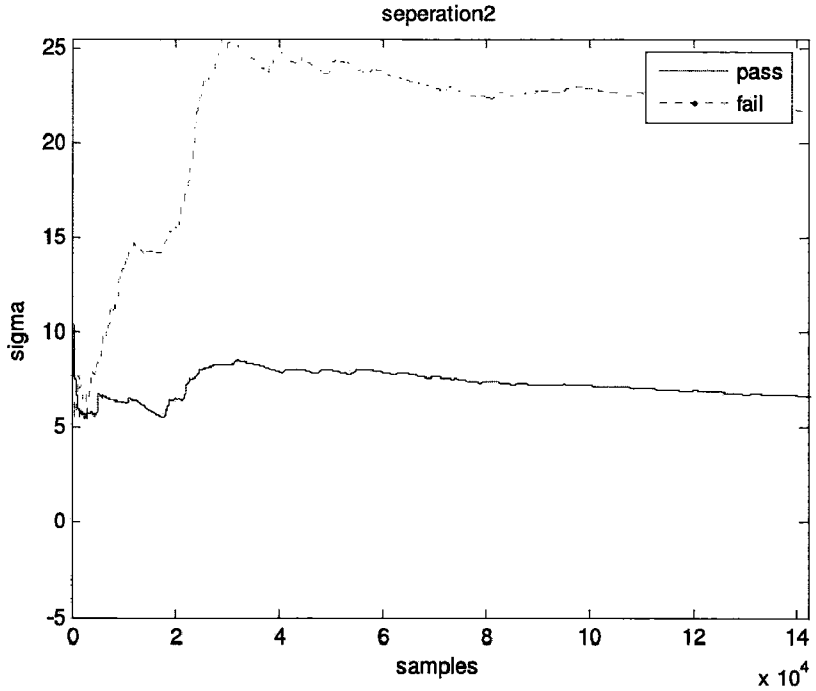
FIG. 6 illustrates exemplary signals based on oxygen sensor signals indicating an air-fuel imbalance and no air-fuel imbalance.
Figure 6:
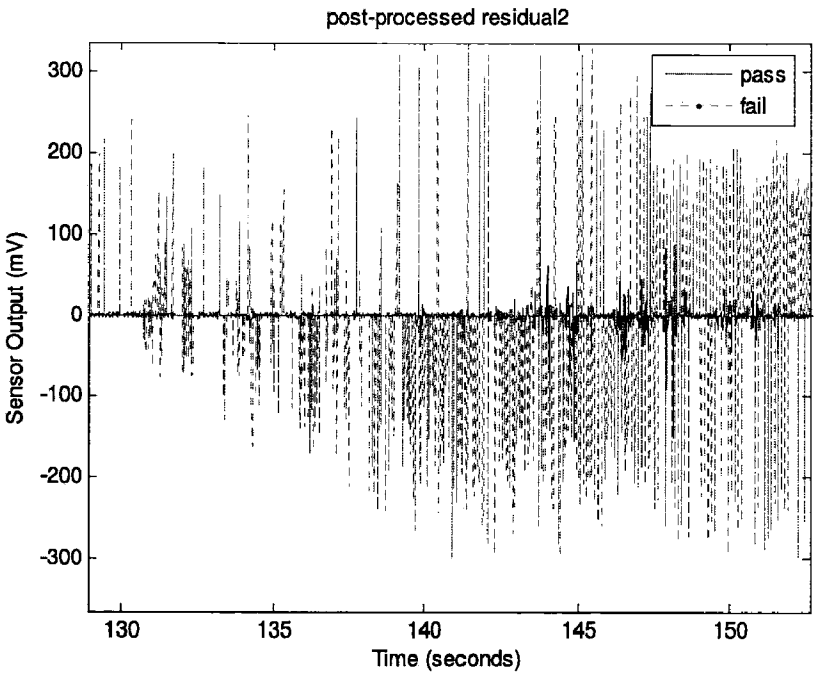

Referring now to FIG. 6, exemplary post-processed signals indicative of an engine having an air-fuel imbalance and an engine having no air-fuel imbalance are illustrated. In the graph on the left, the y-axis represents a residual (i.e., difference) between the unfiltered and filtered $O_2$ sensor signals and the x-axis represents a time period during which the $O_2$ sensor signal was monitored to detect an air-fuel imbalance. The graph on the left compares a passing residual (i.e., does not indicate an air-fuel imbalance) and a failing residual (i.e., indicates an air-fuel imbalance). While the passing residual is near 0 mV for a majority of the monitored time period, the failing residual exhibits several spikes with magnitudes exceeding 300 mV.

In the graph on the right, the y-axis represents a variance of the residual between the unfiltered and filtered $O_2$ sensor signals and the x-axis represents the number of samples from the $O_2$ sensor signal monitored to detect an air-fuel imbalance. The graph on the right compares a passing variance (i.e., does not indicate an air-fuel imbalance) and a failing variance (i.e., indicates an air-fuel imbalance). The passing variance remains relatively constant compared to the failing variance, and the magnitude of the passing variance is significantly lower than the magnitude of the failing variance.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A control system, comprising:

a filtering module that determines a filtered signal based on an oxygen signal, which is based on an oxygen concentration level in an exhaust gas of an engine; and an air-fuel imbalance detection module that detects an air-fuel imbalance in said engine based on a difference between said oxygen signal and said filtered signal.

2. The control system of claim 1 further comprising an oxygen sensor that generates said oxygen signal and is a pre-catalyst oxygen sensor.

3. The control system of claim 1 wherein said air-fuel imbalance detection module sets a service indicator when said air-fuel imbalance is detected.

4. The control system of claim 1 wherein said filtering module filters said oxygen signal to determine said filtered signal.

5. The control system of claim 4 wherein said filtering module filters said oxygen signal using a low-pass filter.

6. The control system of claim 4 wherein said filtering module filters said oxygen signal using a zero-phase filter.

7. The control system of claim 4 wherein said filtering module filters said oxygen signal using a digital filter.

8. The control system of claim 1 wherein said air-fuel imbalance detection module:

determines said difference between said oxygen signal and said filtered signal;

determines an index based on a variance of said difference; and detects said air-fuel imbalance when said index exceeds a predetermined threshold.

9. The control system of claim 8 wherein said air-fuel imbalance detection module calculates said variance of said difference and filters said variance of said difference to determine said index.

10. The control system of claim 8 wherein said air-fuel imbalance detection module detects said air-fuel imbalance when said index exceeds said predetermined threshold for a predetermined time period.

11. A method, comprising:

determining a filtered signal based on an oxygen signal, which is based on an oxygen concentration level in an exhaust gas of an engine; and detecting an air-fuel imbalance in said engine based on a difference between said oxygen signal and said filtered signal.

12. The method of claim 11 wherein said oxygen signal is based on said oxygen concentration level in said exhaust gas before said exhaust gas enters a catalytic converter.

13. The method of claim 11 further comprising setting a service indicator when said air-fuel imbalance is detected.

14. The method of claim 11 further comprising filtering said oxygen signal to determine said filtered signal.

15. The method of claim 14 further comprising filtering said oxygen signal using a low-pass filter.

16. The method of claim 14 further comprising filtering said oxygen signal using a zero-phase filter.

17. The method of claim 14 further comprising filtering said oxygen signal using a digital filter.

18. The method of claim 11 further comprising:

determining said difference between said oxygen signal and said filtered signal;

determining an index based on a variance of said difference; and detecting said air-fuel imbalance when said index exceeds a predetermined threshold.

19. The method of claim 18 further comprising calculating said variance of said difference and filtering said variance of said difference to determine said index.

20. The method of claim 18 further comprising detecting said air-fuel imbalance when said index exceeds said predetermined threshold for a predetermined time period.

* * * * *